US008622784B2

(12) United States Patent
Miller et al.

(10) Patent No.: US 8,622,784 B2
(45) Date of Patent: Jan. 7, 2014

(54) METHOD FOR SELECTIVELY REMOVING PORTIONS OF AN ABRADABLE COATING USING A WATER JET

(75) Inventors: Mitchell O. Miller, Kings Mountain, NC (US); William R. Pearson, Kings Mountain, NC (US); William R. Thompson, Greenville, SC (US)

(73) Assignee: Huffman Corporation, Clover, SC (US)

( * ) Notice: Subject to any disclaimer, the term of this patent is extended or adjusted under 35 U.S.C. 154(b) by 814 days.

(21) Appl. No.: 12/459,258

(22) Filed: Jun. 29, 2009

(65) Prior Publication Data

US 2010/0003894 A1 Jan. 7, 2010

Related U.S. Application Data

(60) Provisional application No. 61/133,788, filed on Jul. 2, 2008.

(51) Int. Cl.
*B24B 1/00* (2006.01)

(52) U.S. Cl.
USPC ..... 451/29; 451/40

(58) Field of Classification Search
USPC ..... 29/889.1, 402.09, 402.13; 216/41, 45, 216/46; 451/5, 29, 30, 31, 38, 39, 40, 445
See application file for complete search history.

(56) References Cited

U.S. PATENT DOCUMENTS

| | | | | |
|---|---|---|---|---|
| 5,593,528 | A * | 1/1997 | Dings et al. | 156/154 |
| 5,804,009 | A * | 9/1998 | Dings et al. | 156/154 |
| 5,810,644 | A * | 9/1998 | Schmidt | 451/29 |
| 5,833,516 | A * | 11/1998 | De Haas et al. | 451/29 |
| 6,183,347 | B1 * | 2/2001 | Shaw | 451/36 |
| 6,905,396 | B1 | 6/2005 | Miller et al. | 451/38 |
| 7,544,112 | B1 | 6/2009 | Miller et al. | 451/2 |
| 2004/0256504 | A1 * | 12/2004 | Segrest et al. | 241/1 |
| 2005/0123785 | A1 | 6/2005 | Sahoo et al. | 428/655 |
| 2005/0260434 | A1 | 11/2005 | Nelson et al. | 428/632 |
| 2009/0311416 | A1 * | 12/2009 | Nelson et al. | 427/8 |

FOREIGN PATENT DOCUMENTS

| | | | |
|---|---|---|---|
| DE | 10 2005 025 205 | B3 | 3/2007 |
| EP | 1 598 439 | A2 | 11/2005 |
| EP | 1 642 993 | A1 | 4/2006 |
| EP | 1 801 248 | A2 | 6/2007 |
| JP | 4-34671 | | 11/1992 |

OTHER PUBLICATIONS

European Search Report.

* cited by examiner

*Primary Examiner* — Timothy V Eley
(74) *Attorney, Agent, or Firm* — K&L Gates LLP

(57) ABSTRACT

A method and apparatus for forming raised ridges on the surface of a turbine component having an abradable coating formed on an outer surface thereof which includes a mask having a predetermined pattern of openings therein adjacent the abradable coating on a surface of the turbine component; and a high pressure water jet that has movement relative to the mask so that the high pressure water jet passes along the extent of the openings in the mask and passes through the openings in the mask to remove portions of the abradable coating on the turbine component located beneath the openings in the mask.

5 Claims, 5 Drawing Sheets

METHOD FOR SELECTIVELY REMOVING PORTIONS OF AN ABRADABLE COATING USING A WATER JET

CROSS-REFERENCE TO RELATED APPLICATIONS

This application is entitled to the benefit of, and claims priority to, provisional U.S. Patent Application Ser. No. 61/133,788, filed Jul. 2, 2008 and entitled "METHOD FOR SELECTIVELY REMOVING AN ABRADABLE COATING FROM A SUBSTRATE USING AN ABRASIVE WATER JET," the entirety of which is incorporated herein by reference.

BACKGROUND OF THE INVENTION

The present invention relates to a method for selectively removing portions of an abradable coating from a substrate using a mask or stencil and a water jet, or an abrasive water jet to create a pattern of raised ridges on the abradable coating of the substrate. In typical applications of the present invention, the abradable coating may be a thermal barrier coating (TBC) bonded over a bond coat, or it may be a more abradable coating applied over the TBC, such as a TBC having a filler. A typical bond coat applied to turbine components is known in the trade as a MCrAlY coating.

Materials for gas turbine combustion components, such as liners, shrouds, blades, and the like, have reached their limits relative to heat in the turbine which may exceed the melting point of the components. Two methods are currently used to increase component life in the turbine. The first method is to add holes to the component so that air or other cooling gas can exit the holes and create a film of air across the surface which helps keep it cool. The second method is to add a coating, such as a TBC coating, to the surface of the part. The present invention relates to turbine components or other substrates that have a coating added using the second method. By way of example, the shroud of a turbine usually is in the form of a continuous ring or a series of panels sequentially arranged in a cylindrical pattern to form an enclosure for a rotating turbine rotor having radially extending turbine blades. Somewhat recently, an abradable coating has been added to the surface of the TBC on a turbine shroud to allow a better seal between the blade tips and housing. Upon initial rotation, the rotating blades on the turbine rotor actually cut into the abradable coating, creating a better seal which improves compression in the turbine. There are a variety of abradable materials that may be used depending on the particular application, such as, for example, a TBC coating having a polyester filler that makes the coating more abradable, nickel graphite and AlSi-polyester. However, the abradable coating may be formed of a variety of other similar and known materials, depending on the application of the present invention.

Included in the abradable coating is a pattern of raised ridges that project outwardly from the surface of the shroud. Currently, these ridges are formed using a thermal spray process and a mask or stencil. The mask is a flat piece of metal with a pattern of openings cut into it. The abradable coating is sprayed through openings in the mask onto the shroud. The openings in the mask allow for the abradable coating to pass through the mask and onto the surface of the shroud, creating the pattern of raised ridges.

Unfortunately, the abradable coating builds up in the openings in the mask and quickly begins to reduce the amount of coating which is deposited onto the shroud. Because the mask is repeatedly clogged, the mask must be changed frequently, causing interruption in the thermal spray process. These interruptions may result in the coating being formed as a number of stacked layers instead of the preferred single, uniform layer, and in some cases requires a total rework of the component. This increases the cycle time for the process, lowers the quality with the creation of varying mask openings due to coating buildup, decreases coating bond due to the interruption of the thermal spray process to clean the mask, decreases coating bond due to the addition of lubrication on the mask to reduce coating buildup, and/or significantly degrades the coating integrity and product life.

Accordingly, a need exists for a method of creating the ridges on the substrate that avoids the repetitive, labor-intensive process that is created by using the current thermal spray process and mask.

DESCRIPTION OF PREFERRED EMBODIMENTS

Figure 1:
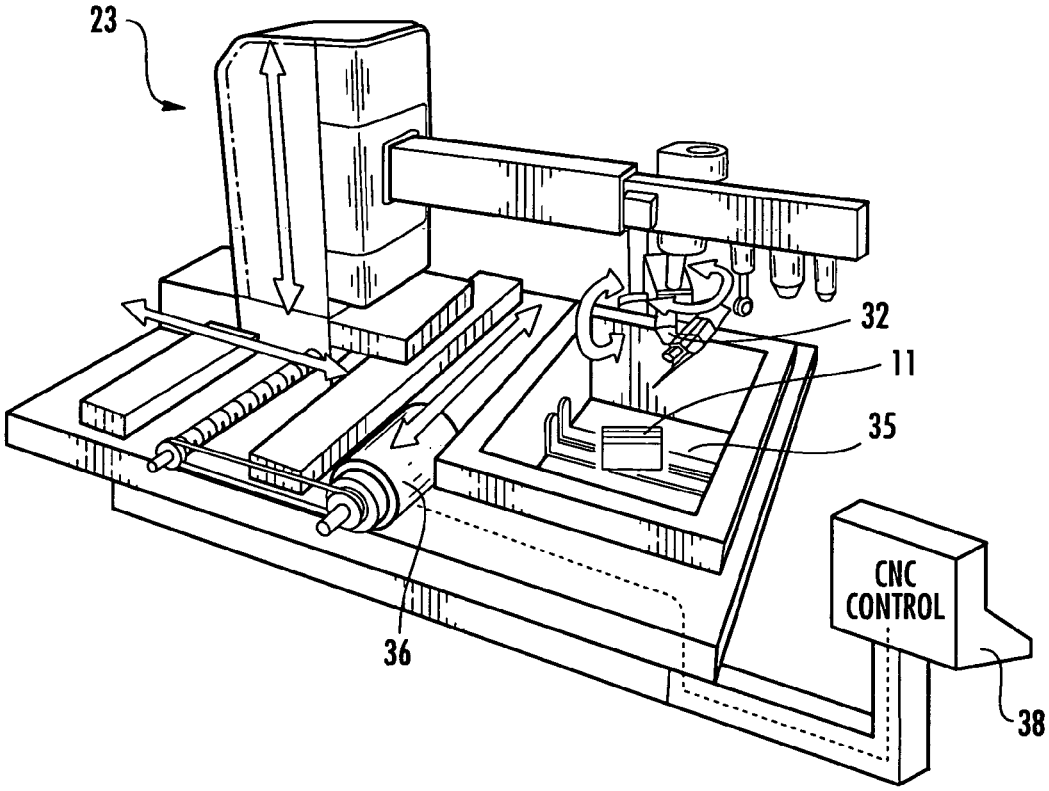
FIG. 1 is a schematic perspective view of a water jet machine suitable for use in performing the selective removing of abradable coating of the present invention.
Figure 2:
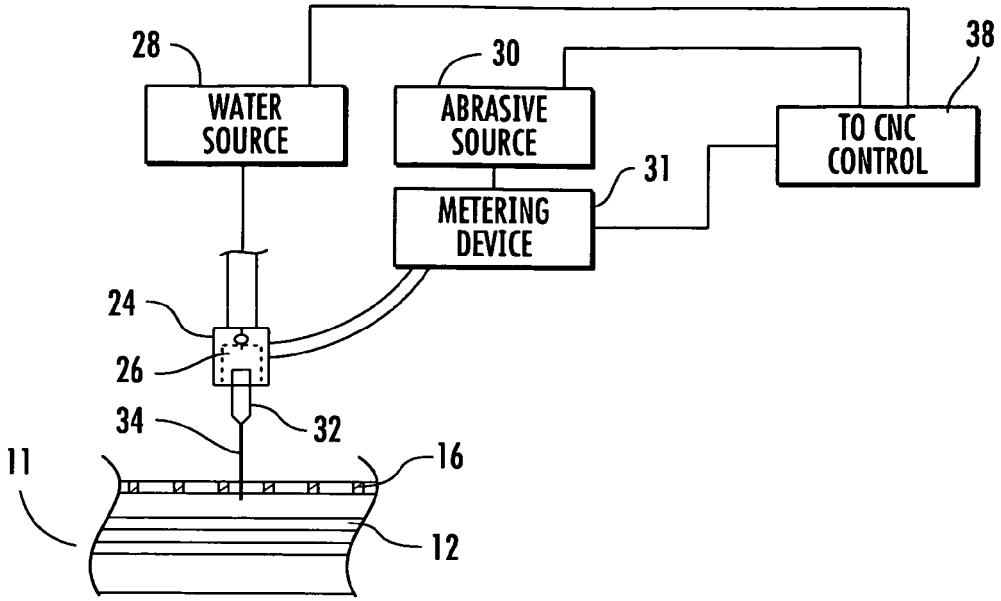
FIG. 2 is a diagrammatic view of the apparatus illustrated in FIG. 1.

Looking now in greater detail at the accompanying drawings, FIG. 1 illustrates a typical water jet apparatus 23 that has been modified in accordance with the present invention to form raised ridges in the abradable surface of a turbine component, and FIG. 2 illustrates diagrammatically the operation of the water jet apparatus 23.

In one preferred embodiment of the present invention, the selective removal of the abradable coating, which will be described in greater detail below, is carried out using a known abrasive jet apparatus 23 (see FIGS. 1 and 2) of the type disclosed in more detail in U.S. Pat. No. 6,905,396, which is enhanced in accordance with the present invention as also described in greater detail below. The details of the known abrasive water jet apparatus 23 itself, as disclosed in the '396 patent, form no part of the present invention, and therefore only the basic components of the abrasive water jet apparatus 23 are illustrated in FIGS. 1 and 2. They include a water jet head 24 having a mixing chamber 26 that receives water from a water source 28. The apparatus 23 includes a source 30 of an abrasive material which is selectively delivered through a metering device 31 to the mixing chamber 26, and the combined water and abrasive is delivered from a delivery nozzle 32 as a jetted fluid stream or abrasive water jet 34, usually in the range of 5,000 psi to 55,000 psi. As best seen in FIG. 1, the delivery nozzle 32 is manipulated relative to the workpiece about a plurality of axes (e.g. five axes, as indicated by arrows) by a plurality of motors 36, only one of which is shown diagrammatically in FIG. 1, and these motors are controlled through a conventional control system 38 that includes a conventional programmable computer (not shown) to position and move the delivery nozzle 32 relative to the workpiece 11, and to properly control the various parameters associated with the apparatus 23 to vary the material removal rate of the abrasive water jet 34.

Figure 3:
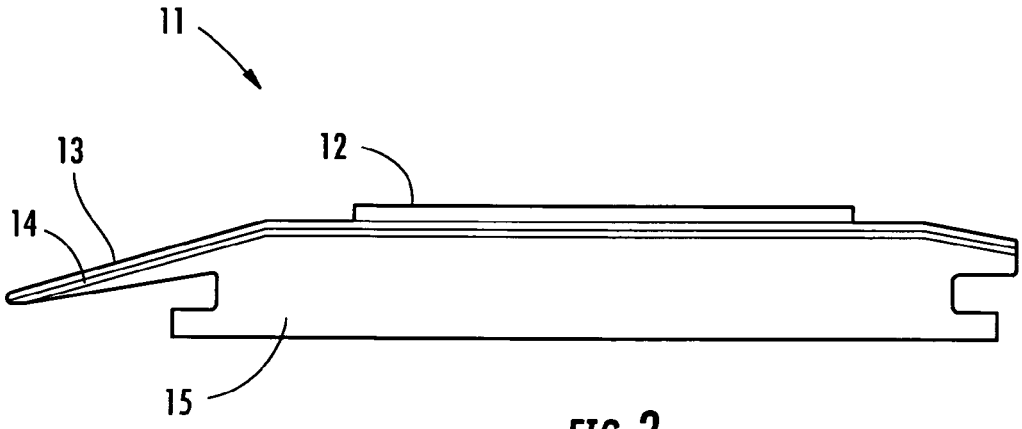
FIG. 3 shows a typical industrial gas turbine component, a shroud panel, with an abradable coating on the surface that can be selectively removed using the present invention.

FIG. 3 illustrates a typical industrial gas turbine component whose abradable coating can be formed utilizing the method of the present invention, but it will be understood that the present invention may be used with many other substrates and other turbine components. The turbine component in FIG. 3 is one typical panel 11 of a conventional turbine shroud which, as described above, includes a plurality of such panels sequentially arranged in a cylindrical pattern to form an enclosure for a rotating turbine rotor having radially extending turbine blades (not shown). FIG. 3 shows the composition of a typical shroud panel 11. A conventional bond coat 14 (e.g. a MCrAlY coating) has been applied to the parent material 15, and a TBC 13 has been applied over the bond coat 14. Finally, an abradable coating 12 has been applied over the TBC 13. It is the outer surface of the abradable coating 12 on the shroud panel 11 that will be engaged by the tips of the rotating turbine blades. In the preferred embodiment of the present invention, the abradable coating is a TBC coating that includes an AlSi-polyester and nickel graphite filler which provides a more abradable coating than the TBC alone, but other similar abradable coatings may be used, or in some applications of the present invention the conventional TBC layer on the bond coat may form the abradable coating.

Figure 4:
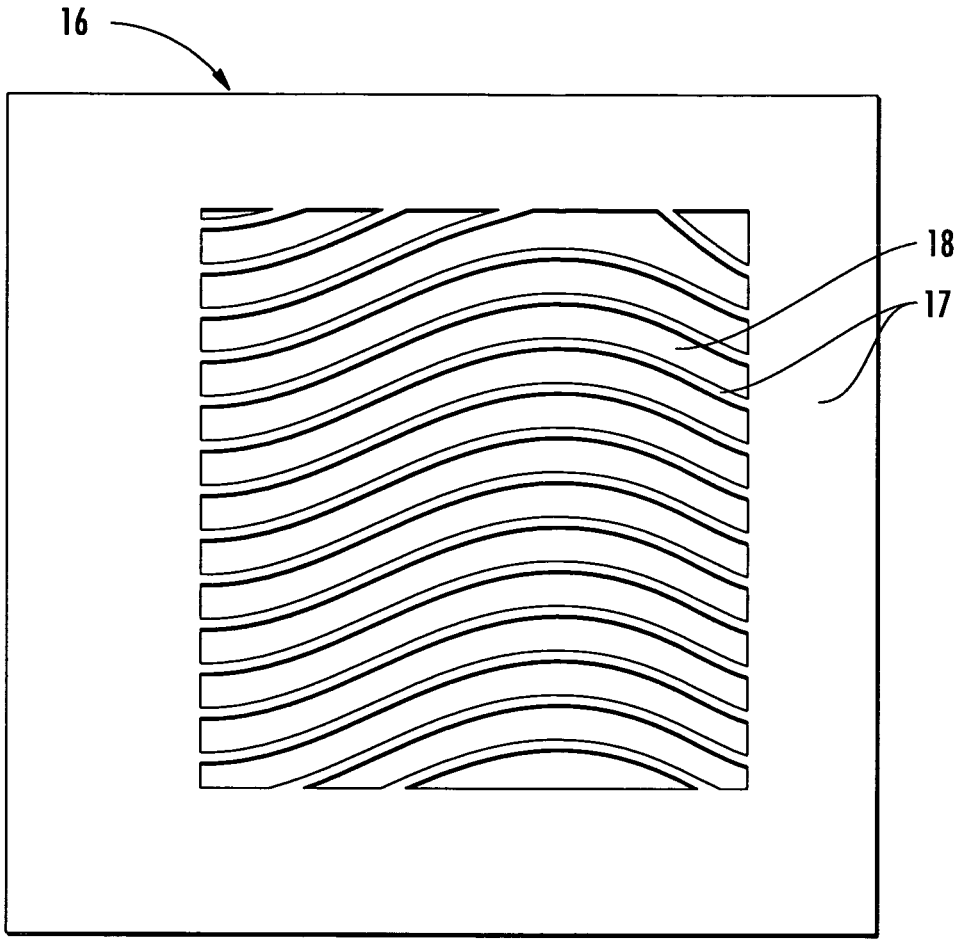
FIG. 4 shows a mask used to create the raised ridges in accordance with the present invention.

FIG. 4 shows an example of a typical mask or stencil 16 used to create a pattern of raised ridges in the abradable coating 12 in accordance with the present invention. The mask 16 is usually flat, thin, and includes an impervious base portion 17 in which a desired pattern of openings or slots 18 pass through the thickness of the mask 16. The pattern of the openings 18 in the mask 16 shown in FIG. 4 is merely representative of only one of a large number of different patterns that may be formed in the mask 16. In many applications of the present invention where air is intended to pass through the furrows, it is preferred to form the openings 18 with a curved or wavy configuration as illustrated in FIG. 4, so that the furrows 24 formed by the jet passing through the openings 18 (see FIG. 7) will have a more extended length as compared with furrows extending in a straight line, and will therefore provide improved cooling of the shroud panel by the air that passes through the curved furrows 24. The mask 16 is preferably formed of steel, stainless steel, or carbides, but other suitable materials may also be used.

Figure 5:
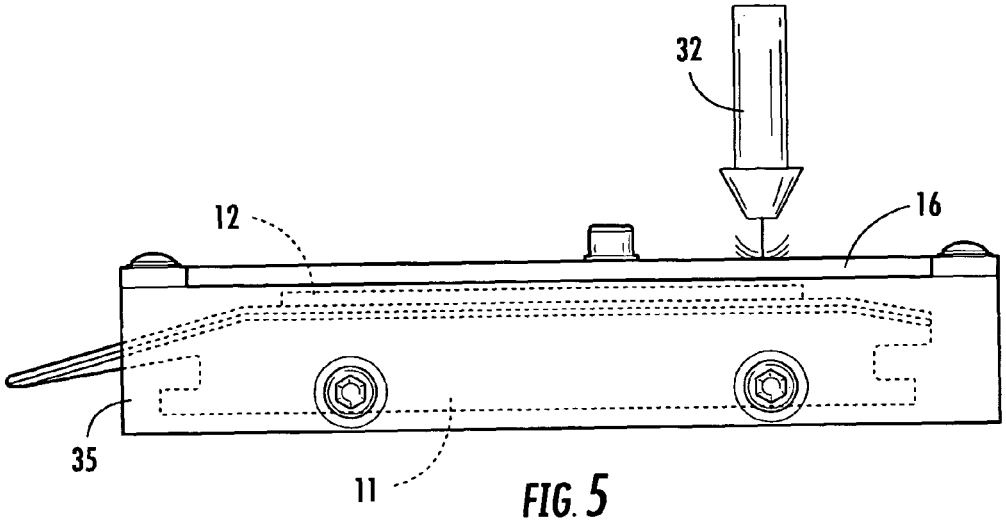
FIG. 5 shows the shroud panel, mask, and water jet nozzle.
Figure 5A:
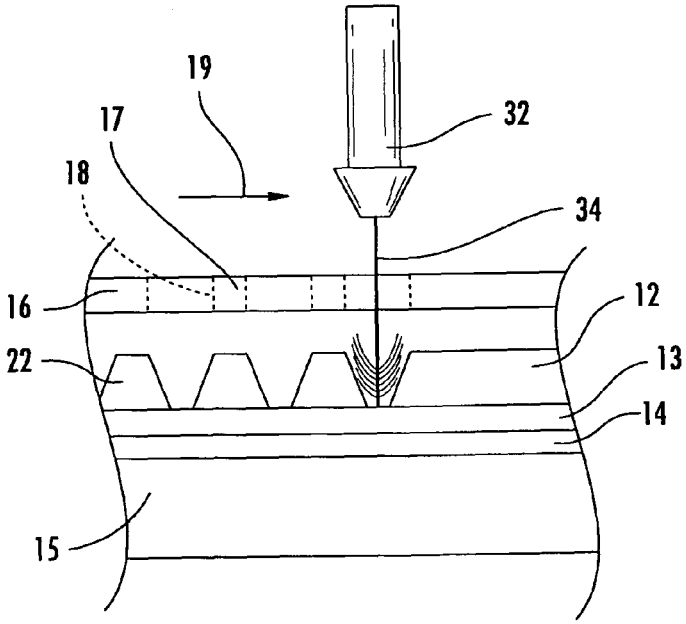
FIG. 5A is a detail view of the shroud panel, mask, and water jet nozzle illustrated in FIG. 5.

In accordance with the preferred embodiment of the present invention, a metal substrate, such as the turbine shroud panel 11 or other workpiece with an abradable coating 12 that needs to be selectively removed, is mounted on the workpiece holding system 35, and as illustrated in FIG. 5, the mask 16 is mounted in position by the workpiece holding system 35 so that it is adjacent to and above the outer surface of the abradable coating 12 as best illustrated in FIGS. 5 and 5A.

FIG. 5 illustrates the arrangement of the shroud panel 11, the mask 16, and the water jet nozzle 32. The water jet nozzle 32 will be moved relative to the workpiece holding system 35 and the shroud panel 11 by the control system 38 of the water jet apparatus 23 as shown in the exploded view of 5A. The direction of movement of the water jet nozzle 32 by the control system 38, which is indicated by the direction arrow 19, results in the water jet nozzle 32 being moved along the extent of each of the openings 18, and the water jet 34 will penetrate the mask 16 by passing through each of the openings 18 and the cutting force of the water jet 34 will remove portions of the abradable coating located beneath the openings 18 while leaving in place the portions of the abradable coating 12 that are not located beneath the openings 18 to thereby form the raised ridges 22 on the outer surface of the shroud panel 11. Thus, by using the high pressure water jet 34 to remove selected portions of the abradable coating 12, furrows or grooves 24 are formed in the surface of the abradable coating 12 that correspond to the openings 18 in the masks 16, and the remaining raised ridges 22 of the abradable coating 12 are thereby formed between these furrows.

Figure 6:
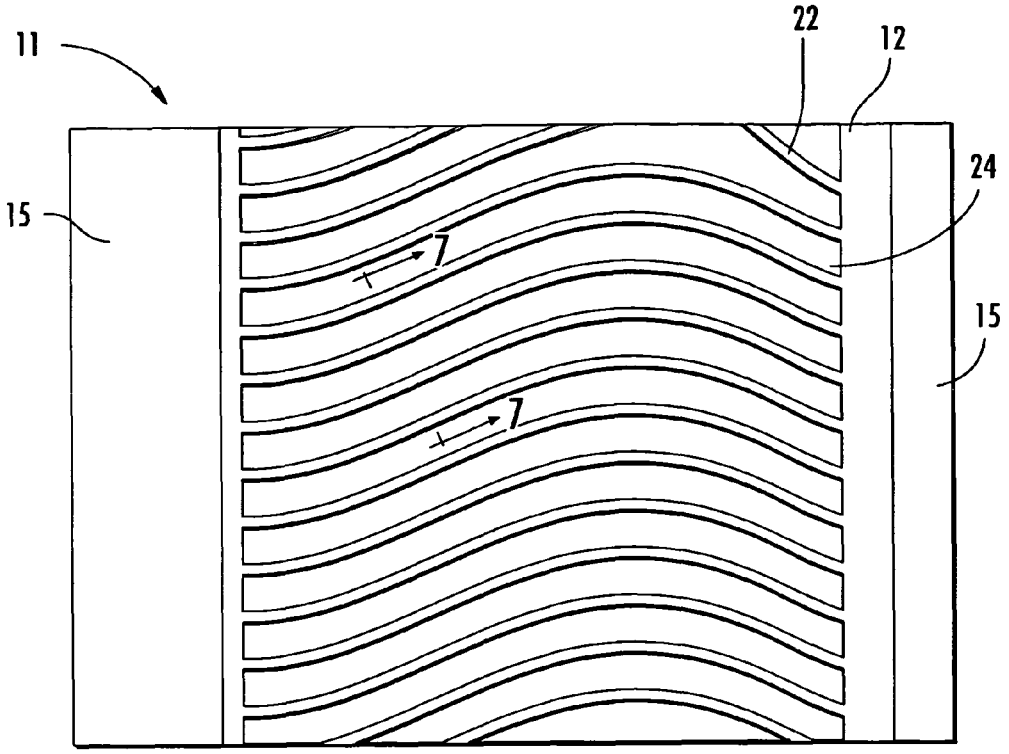
FIG. 6 shows diagrammatically a plan view of the shroud panel with raised ridges formed in the abradable coating on the shroud panel.
Figure 7:
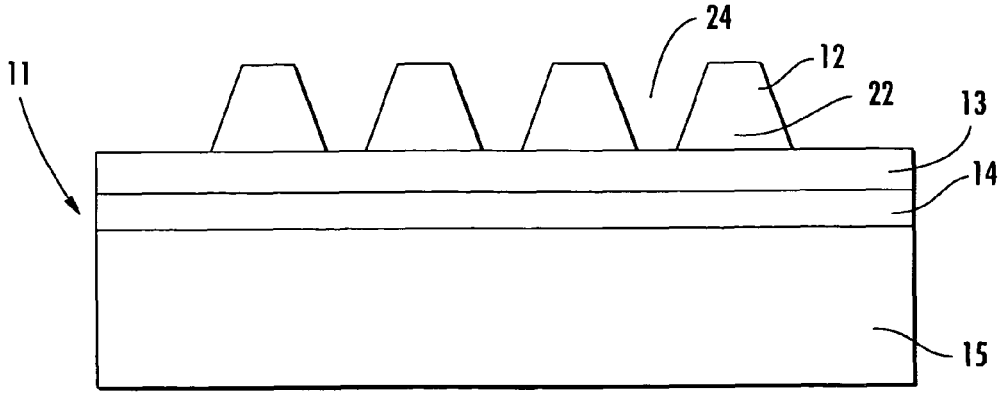
FIG. 7 shows a cross-section of the shroud panel with the resultant ridges of abradable coating left on the surface of the TBC, taken along line A-A in FIG. 6.

FIG. 6 shows a plan view of the shroud panel 11 after it has been processed in accordance with the present invention, with the resulting pattern of raised ridges 22 on the surface of the TBC coating 13 due to the removal of the sections of the abradable coating 12 below the openings 18 of the mask 16. FIG. 7 is a cross-section view of the shroud panel 11 taken along line A-A in FIG. 6 of the finished shroud panel 11 that further shows the resultant ridges 22 left on the surface of the TBC 13. Where the turbine component is one panel 11 of a turbine shroud that forms an enclosure for a rotating turbine blade, the raised ridges 22 will provide a seal for the rotating turbine blade as described above. When the jet 34 passes through the openings 18 in the mask 16 the abrasive effect caused by the jet 34 dissipates somewhat as the jet 34 penetrates the abrasive coating 12, and as a result the furrows are usually formed as inverse pyramids as best seen in FIG. 7. Preferably, in turbine shroud panels, the ridges 22 will typically have a height of about 0.045-inch, a width of about 0.075-inch at the base of the ridges, and a width of about 0.020-inch at the top of the ridges 22, but these dimensions may vary.

It will be expressly understood, however, that the configuration of the ridges 22 as illustrated in FIG. 6 are representative only, and the mask 16 may also be designed to form ridges in a wide variety of shapes, sizes and patterns, depending on the application of the present invention. Likewise, the mask may be designed to form the furrows or spaces between the ridges in a wide variety of shapes, sizes and patterns, depending on how the furrows are to be used.

The present invention is not to be limited to the use of an abrasive water jet and can be carried out as described above with an abrasive water jet, or in some applications with a water only jet, or by a combination of passes with an abrasive water jet followed by or preceded by passes with a water only jet. Although use of the abrasive water jet will reduce cycle time, different factors or conditions may make it desirable to utilize a water jet only in the above combinations.

In view of the aforesaid written description of the present invention, it will be readily understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended nor is to be construed to limit the present invention or otherwise to exclude any such other embodiments, adaptations, variations, modifications and equivalent arrangements, the present invention being limited only by the claims appended hereto and the equivalents thereof.

The invention claimed is:

1. A method of forming raised ridges on the surface of a turbine component having an abradable coating formed on an outer surface of the turbine component, said method comprising the steps of:

(a) positioning a mask having a predetermined pattern of openings therein adjacent to and above the abradable coating on a surface of the turbine component;

(b) providing a high pressure water jet; and (c) causing the high pressure water jet to have movement relative to the mask so that the high pressure water jet passes along the extent of the openings in the mask and passes through the openings in the mask to remove portions of the abradable coating on the turbine component located beneath the openings in the mask while leaving in place portions of the abradable coating that are not located beneath the openings to thereby form raised ridges of abradable material on the surface of the turbine component.

2. A method of forming raised ridges on the surface of a turbine component as defined in claim 1 wherein the method includes the step of adding an abrasive material to the high pressure water jet.

3. A method of forming raised ridges on the surface of a turbine component as defined in claim 1 wherein the turbine component is a shroud panel formed with a bond coat, a TBC layer covering the bond coat, with the abradable coating applied to the TBC layer on the shroud panel.

4. A method of forming raised ridges on the surface of a turbine component as defined in claim 1 wherein the abradable coating is a TBC coating that includes an AlSi-polyester and nickel graphite filler.

5. A method of forming raised ridges on the surface of a turbine component as defined in claim 1, wherein the turbine component includes a base parent material, a bond coat applied to the base parent material, and a TBC applied over the bond coat, and wherein the abradable coating is applied over the TBC.

* * * * *